US011060361B2

(12) United States Patent
Berry et al.

(10) Patent No.: US 11,060,361 B2
(45) Date of Patent: Jul. 13, 2021

(54) RETRACTABLE TOP DRIVE WITH TORQUE TUBE

(71) Applicant: SCHLUMBERGER TECHNOLOGY CORPORATION, Sugar Land, TX (US)

(72) Inventors: Joe Rodney Berry, Cypress, TX (US); Robert Metz, Cypress, TX (US); Melvin Alan Orr, Tulsa, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 39 days.

(21) Appl. No.: 16/097,403

(22) PCT Filed: May 1, 2017

(86) PCT No.: PCT/US2017/030330

§ 371 (c)(1),
(2) Date: Oct. 29, 2018

(87) PCT Pub. No.: WO2017/190121

PCT Pub. Date: Nov. 2, 2017

(65) Prior Publication Data

US 2019/0145194 A1 May 16, 2019

Related U.S. Application Data

(60) Provisional application No. 62/330,028, filed on Apr. 29, 2016.

(51) Int. Cl.
*E21B 19/16* (2006.01)
*E21B 3/02* (2006.01)

(52) U.S. Cl.
CPC ..... *E21B 19/16* (2013.01); *E21B 3/02* (2013.01)

(58) Field of Classification Search
CPC ..... E21B 3/02
USPC ..... 166/379
See application file for complete search history.

(56) References Cited

U.S. PATENT DOCUMENTS 5,433,279 A * 7/1995 Tessari ..... E21B 19/16 173/147
7,188,686 B2 3/2007 Folk et al.
8,074,711 B2 12/2011 Ellis et al.
8,955,602 B2 2/2015 Pilgrim
9,291,010 B1 3/2016 Barnes
(Continued)

FOREIGN PATENT DOCUMENTS

CN 202064840 U 12/2011
CN 202706908 U 1/2013
(Continued)

*Primary Examiner* — Taras P Bemko
(74) *Attorney, Agent, or Firm* — Jeffrey D. Frantz

(57) ABSTRACT

A retractable top drive for use with a drilling rig and process for operating a drilling rig. The retractable top drive comprises a dolly having a pair of mast rails in translatable relation to a mast, such as sliding. A yoke pivotally connects a torque tube to the dolly and the top drive is connected to the torque tube, so that a substantial portion of the top drive is positioned lower than a substantial portion of the dolly. An extendable actuator is connected between the dolly and the yoke to translate the top drive to/from the dolly. Torque is transferred from the top drive through the torque tube, yoke and dolly into the mast of the drill rig.

16 Claims, 10 Drawing Sheets

(56) References Cited

U.S. PATENT DOCUMENTS

| | | | |
|---|---|---|---|
| 2005/0126800 | A1 | 6/2005 | Orr et al. |
| 2009/0084537 | A1 | 4/2009 | Rudshaug et al. |
| 2016/0090786 | A1 | 3/2016 | Roodenburg et al. |

FOREIGN PATENT DOCUMENTS

| | | | |
|---|---|---|---|
| CN | 104389514 | A | 3/2015 |
| WO | 2013077905 | A2 | 5/2013 |

* cited by examiner

RETRACTABLE TOP DRIVE WITH TORQUE TUBE

CONTINUATION STATEMENT

This application claims priority to U.S. Provisional Application No. 62/330,028, filed 29 Apr. 2016.

TECHNICAL FIELD

The present disclosure relates to a drilling rig and system for moving drill pipe and drill collars into and out of a subterranean wellbore. In particular, the present invention is directed to a retractable top drive (RTD) for use on a drilling rig designed to significantly reduce trip time of drill string. In particular, the present design is configured for use with a secondary hoisting machine translatably mounted to the same mast as the retractable top drive.

BACKGROUND ART

In the exploration of oil, gas and geothermal energy, drilling operations are used to create boreholes, or wells, in the earth. Drilling rigs used in subterranean exploration must be transported to the locations where drilling activity is to be commenced. These locations are often remotely located in rough terrain. The transportation of such rigs on state highways requires compliance with highway safety laws and clearance underneath bridges or inside tunnels. Once transported to the desired location, large rig components must each be moved from a transport trailer into engagement with the other components located on the drilling pad.

Moving a full-size drilling rig requires disassembly and reassembly of the substructure and mast. Safety is of paramount importance. Speed of disassembly and reassembly is also critical to profitability. Complete disassembly leads to errors, delay, and safety risks in reassembly. Modern drilling rigs may have two, three, or even four mast sections for sequential connection and raising above a substructure.

Transportation constraints and cost limit many of the design opportunities for building drilling rigs that can drill a well faster. Conventional drilling involves having a drill bit on the bottom of the well. A bottom-hole assembly is located immediately above the drill bit where directional sensors and communications equipment, batteries, mud motors, and stabilizing equipment are provided to help guide the drill bit to the desired subterranean target.

A set of drill collars are located above the bottom-hole assembly to provide a noncollapsible source of weight to help the drill bit crush the formation. Heavy-weight drill pipe is located above the drill collars for safety, immediately above the neutral point in the drill string, where the components below are in compression and the components above are in tension. The remainder of the drill string is mostly drill pipe, designed to always be under tension. Each drill pipe is roughly 30 feet long, but lengths vary based on the style. It is common to store lengths of drill pipe in "doubles" (2 connected lengths), "triples" (3 connected lengths), or fourables (4 connected lengths).

When the drill string (drill pipe and all other components) must be removed from the drilling rig to change-out the worn drill bit, it is necessary to remove the entire drill string from the well, and set it back in doubles or triples until the drill bit is retrieved and exchanged. This process of pulling everything out of the hole and running it all back in is commonly known as "tripping."

Tripping is non-drilling time and, therefore, a necessary waste. Efforts have been made in the last century to devise ways to avoid it or at least speed it up. Running triples is faster than running doubles because it reduces by one-third the number of threaded connections that must first be disconnected and then reconnected. Triples require taller and more expensive drilling rigs, but they are the only practical alternative when drilling deep.

One option is to operate a pair of opposing masts, each equipped with a fully operational top drive that sequentially swings over the wellbore. In this manner, tripping can be nearly continuous, pausing only to spin connections together or apart. Obvious problems with this drilling rig configuration are the cost of equipment, operation and transportation. Additionally, the problem of racking pipe remains unsolved.

Automatic pipe racking has long been a goal related to reducing trip time. The Iron Derrickman™ is a commercially available mechanism that attempts to replicate the movements of a human derrickman. The device has had very limited commercial success and acceptance. One problem is that it lacks operative redundancy. In the event of a mechanical failure, the mechanism must be repaired or removed, causing an unacceptable interruption in drilling activity.

Top drives are known for land rigs. Some prior art top drive systems are movably mounted on a torque tube that extends vertically and is supported by the drill rig mast. The dolly for guiding a top drive along the mast length is conventionally connected to the top drive, rather than the travelling block. This has the advantage of transmitting the reaction torque at the top drive directly to the dolly and then to the mast rails. The reaction torque at the top drive arises from rotation of the drill string and drill bit by the top drive. For example, U.S. Pat. No. 7,188,686 shows a prior art system having a torque tube that extends nearly from near the rig floor to near the top of the mast and is supported by the mast. A top drive system is movably mounted on the torque tube and is horizontally displaceable by an extension system.

For purposes of this specification, "torque tube" means any structure that transfers torque. For example, the definition of "torque tube" includes but is not limited to: beam, rod, bar, pole, shaft, brace, column, strut, stud, tube, pipe, rail, etc. having any cross-sectional geometry. In particular, the definition of "torque tube" is not limited to a "tube" as it is understood that the word "tube" is merely a linguistic artifact of some early embodiments of drill rig torque transferring structures being tubular in shape.

A top drive designed for a high trip rate drilling rig needs to be retractable to make room for a secondary pipe handling machine within the mast envelope; capable of near drill floor positioning with minimal interference with drill floor mounted pipe handling equipment, and capable of stable transmission of reactive torque to the mast rails. A significant problem arises in that these constraints are in design conflict when applied to known top drive designs. Thus, there continues to be a need for a design solution for a top rotary drive mechanism that can meet the described requirements.

It is desirable to have a drilling rig with the capability of reducing the trip time necessary to change a drill bit or service a bottom-hole assembly. It is further desirable to have a drilling rig that is capable of moving drill pipe over or away from the wellbore with equipment separate from the equipment that hoists the drill string into and out of the wellbore. It is also desirable to have a system that includes redundancy, such that if an element of the system fails or requires servicing, the task performed by that unit can be taken-up by another unit on the drilling rig without a complete cessation of operations for maintenance.

To meet these requirements, a top drive system is needed that is retractable to make room for a secondary pipe handling machine within the mast envelope, and that is capable of near drill floor positioning with minimal interference with drill floor mounted pipe handling equipment, and that further is capable of stable transmission of reactive torque to the mast rails.

The preferred embodiments of the present invention provide a unique solution to the engineering constraints and challenges of providing a rapid, safe, and reliable tripping of drill string components at a significantly faster rate.

SUMMARY OF INVENTION

In accordance with the teachings of the present disclosure, disadvantages and problems associated with existing top drive drilling rig systems are overcome.

The present invention is for a new drilling rig system. The invention comprises a retractable top drive (RTD) vertically translating the internal rear side of a drilling mast. The top drive travels vertically along either of, or between, a retracted centerline and the well centerline. A secondary hoisting device (e.g., a tubular delivery arm) travels vertically along the front structure of the drilling mast, external to the interior of the mast, with lifting capability limited to that of a stand of drilling tubulars. Travel of the tubular delivery arm is wholly independent of the parallel travel of the retractable top drive. The tubular delivery arm can move tubular stands vertically and horizontally in the draw works to V-door direction, reaching positions that include the centerlines for the wellbore, stand hand-off position, mousehole, and the catwalk.

In one embodiment, a retractable top drive comprises a travelling block assembly and a top drive assembly suspended from links of the travelling block assembly. A dolly has a plurality of arms extending outward with a slide assembly at the end of each arm. The slide assemblies are connectable to a pair of mast rails in translatable relation, such as sliding or rolling. A first yoke pivotally connects the travelling block to the dolly. An extendable actuator is connected between the dolly and the first yoke. A torque tube is connected to the travelling block. The torque tube is connected to the top drive in vertically slidable relation. In this embodiment, extension of the actuator pivots the first yoke to extend the travelling block away from the dolly to a position over a well center. Retraction of the actuator pivots the first yoke to retract the travelling block towards the dolly to a position away from the well center.

Also in this embodiment, torque reactions of a drill string responding to rotation by the top drive are transferred from the top drive to the torque tube, from the torque tube to the travelling block, from the travelling block to the dolly, and from the dolly to the mast rails of a mast supporting the retractable top drive.

In another embodiment, the first yoke comprises a connected pair of pivot points at each of its ends. In another embodiment, a second yoke pivotally connects the dolly to the travelling block, and comprises a connected pair of pivot points at each of its ends.

In another embodiment, the travelling block assembly comprises a first sheave assembly (first block) and a second sheave assembly (second block). The first yoke connects to, and separates, each of the first and second sheave assemblies. The first and second sleeve assemblies are rotatable about a common axis.

In another embodiment, each slide assembly comprises a slide pad connected to an adjustment pad. In another embodiment, each slide assembly comprises a roller assembly.

In a further embodiment, a second yoke is mounted lower and wider in the dolly to more directly brace against torque from the top drive. In this embodiment, torque reactions of a drill string responding to rotation by the top drive are transferred from the top drive to a torque tube bracket, from the torque tube bracket to the torque tube, from the torque tube to the second yoke, from the second yoke to the dolly, and from the dolly to the mast rails of a mast supporting the retractable top drive.

Still another aspect of the invention provides a retractable top drive for a wellbore drilling rig, the retractable top drive comprising: a dolly configured to be supported by a mast of the drilling rig so that the dolly is substantially vertically translatable relative to the mast; a yoke having a first end in mechanical communication with the dolly; a torque tube in mechanical communication with a second end of the yoke; a top drive in mechanical communication with the torque tube so that a substantial portion of the top drive is lower than a substantial portion of the dolly; and an actuator in mechanical communication with the yoke to translate the top drive in a direction having a horizontal component relative to the dolly.

According to a further aspect of the invention, there is provided a process for operating a drilling rig, the process comprising: mounting a dolly to a rig mast so that the dolly is substantially vertically translatable relative to the rig mast; mounting a top drive to the dolly so that a substantial portion of the top drive is lower than a substantial portion of the dolly and the top drive is translatable in a direction having a horizontal component relative to the dolly; and transferring torque from the top drive through the dolly and into the mast.

As disclosed, the present invention eliminates the need for a dolly connected to the retractable top drive, thus eliminating the need for rails extending near to the drill floor level, where the rails and lower dolly placement would interfere with automated pipe handling equipment useful to assist a second hoisting mechanism on the mast when manipulating tubular stands of drill pipe, collars and casing between the well center, mousehole, and stand hand-off positions. This further provides clearance for drill floor mounted make-up and breakout machines, known as iron roughnecks.

The present invention provides a novel drilling rig system that significantly reduces the time needed for tripping of drill pipe. The present invention further provides a system with mechanically operative redundancies. The following summary relates to "tripping in" which means adding rack stands of drill pipe from a racking module to form the complete length of the drill string. It will be appreciated by a person of ordinary skill in the art that the procedure summarized below is generally reversed for tripping out of the well.

As will be understood by one of ordinary skill in the art, the assembly disclosed may be modified and the same advantageous result obtained. It will also be understood that as described, the mechanism can be operated in reverse to remove drill stand lengths of a drill string from a wellbore for orderly bridge crane stacking. Although a configuration related to triples is being described herein, a person of ordinary skill in the art will understand that such description is by example only as the invention is not limited, and would apply equally to doubles and fourables.

BRIEF DESCRIPTION OF DRAWINGS

A more complete understanding of the present embodiments may be acquired by referring to the following description taken in conjunction with the accompanying drawings, in which like reference numbers indicate like features.

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DESCRIPTION OF EMBODIMENTS

Preferred embodiments are best understood by reference to FIGS. 1-11B below in view of the following general discussion. The present disclosure may be more easily understood in the context of a high level description of certain embodiments.

Figure 1:
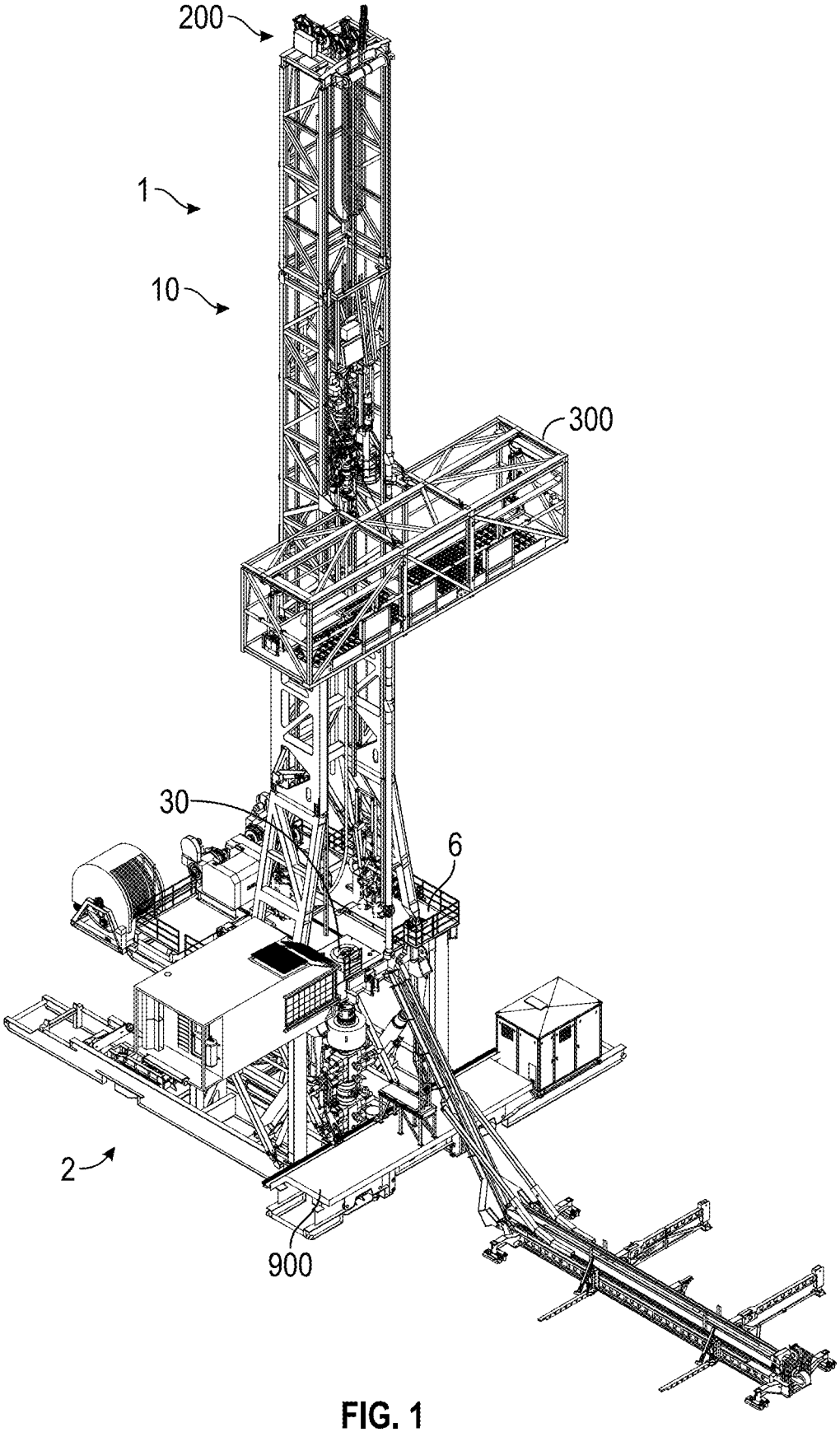
FIG. 1 is an isometric view of an embodiment of the drilling rig system of the present invention for a high trip rate drilling rig.

FIG. 1 shows an embodiment of the invention. The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

FIG. 1 is an isometric view of an embodiment of the drilling rig system of the present invention for a high trip rate drilling rig 1. FIG. 1 illustrates drilling rig 1 having the front portion (V-door portion) removed. In its place, a setback platform 900 is located near ground level, extending over the base box sections of a substructure 2 on the ground. In this position, setback platform 900 is directly beneath racking module 300 such that any pipe stands 80 (not shown) located in racking module 300 will be resting on setback platform 900. In this configuration, racking module 300 is located lower on mast 10 of drilling rig 1 than on conventional land rigs, since the tubular stands 80 are not resting at drill floor level. Additionally, tubular stands 80 will need to be significantly elevated to reach the level of drill floor 6.

As will be seen in the following discussion, this arrangement provides numerous advantages in complementary relationship with the several other unique components of high trip rate drilling rig 1. To be most advantageous, it requires a spacious drill floor 6 to accommodate coupling equipment such as an iron roughneck, and a lower stabilizing arm to control the free movement of tubular stands hoisted by the retractable top drive and the secondary hoisting machine.

Figure 2:
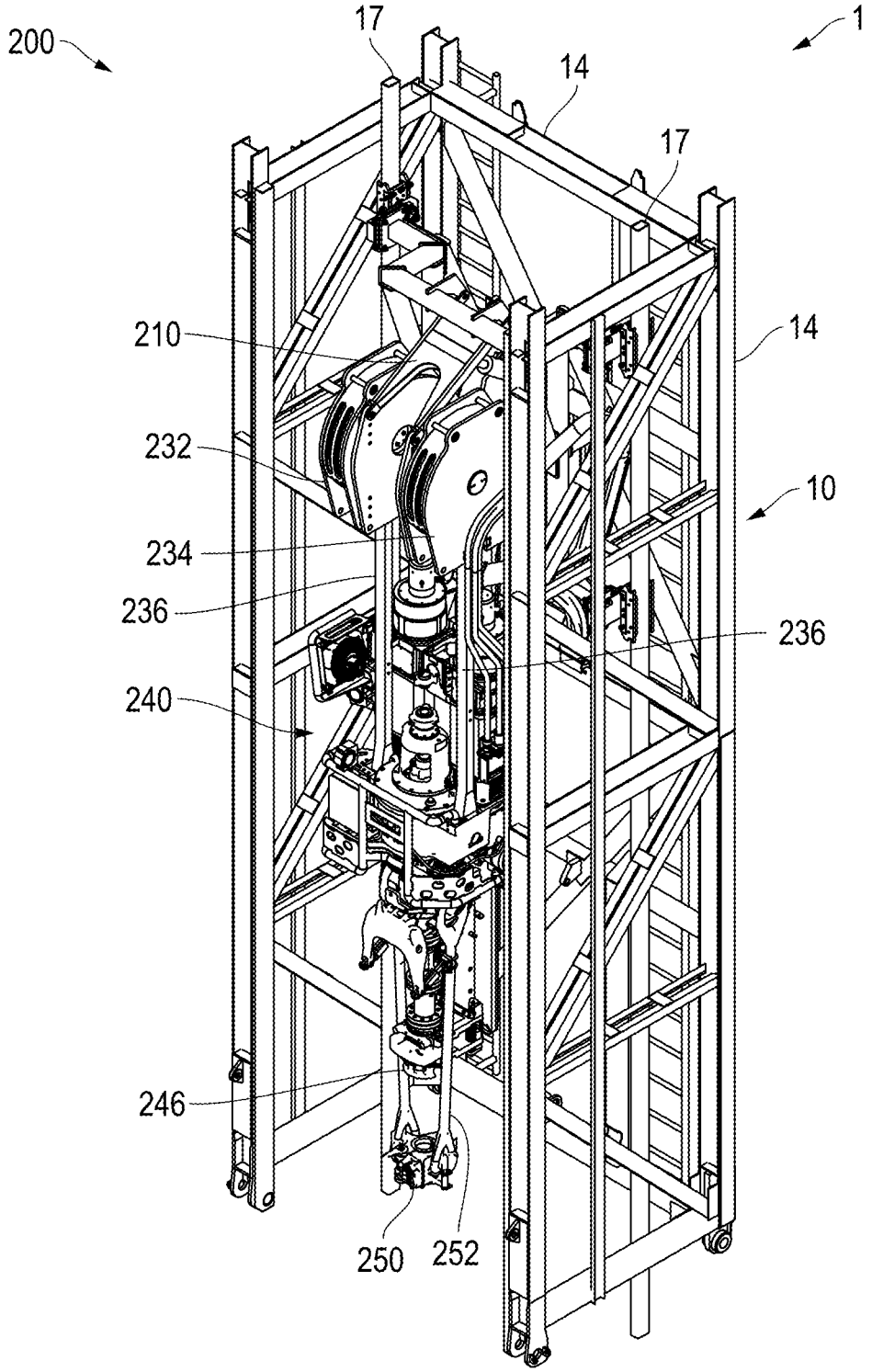
FIG. 2 is an isometric view of a top portion of the drilling system of FIG. 1.

FIG. 2 is an isometric cut-away view of RTD 200 in drilling mast 10 as used in an embodiment of the high trip rate drilling rig 1. RTD 200 has a dolly 202 that is mounted on guides 17 in mast 10. Guides 17 are proximate to the rear side 14 (draw works side) of mast 10. Dolly 202 is vertically translatable on the length of guides 17. In the embodiment illustrated, RTD 200 has a split block including a driller's side block 232 and an off-driller's side block 234. This feature provides mast-center path clearance additional to that obtained by the ability to retract dolly 202.

A yoke 210 connects block halves 232 and 234 to dolly 202. An actuator 220 (see FIG. 3) extends between yoke 210 and dolly 202 to facilitate controlled movement of the RTD between a well center position and a retracted position.

Figure 3:
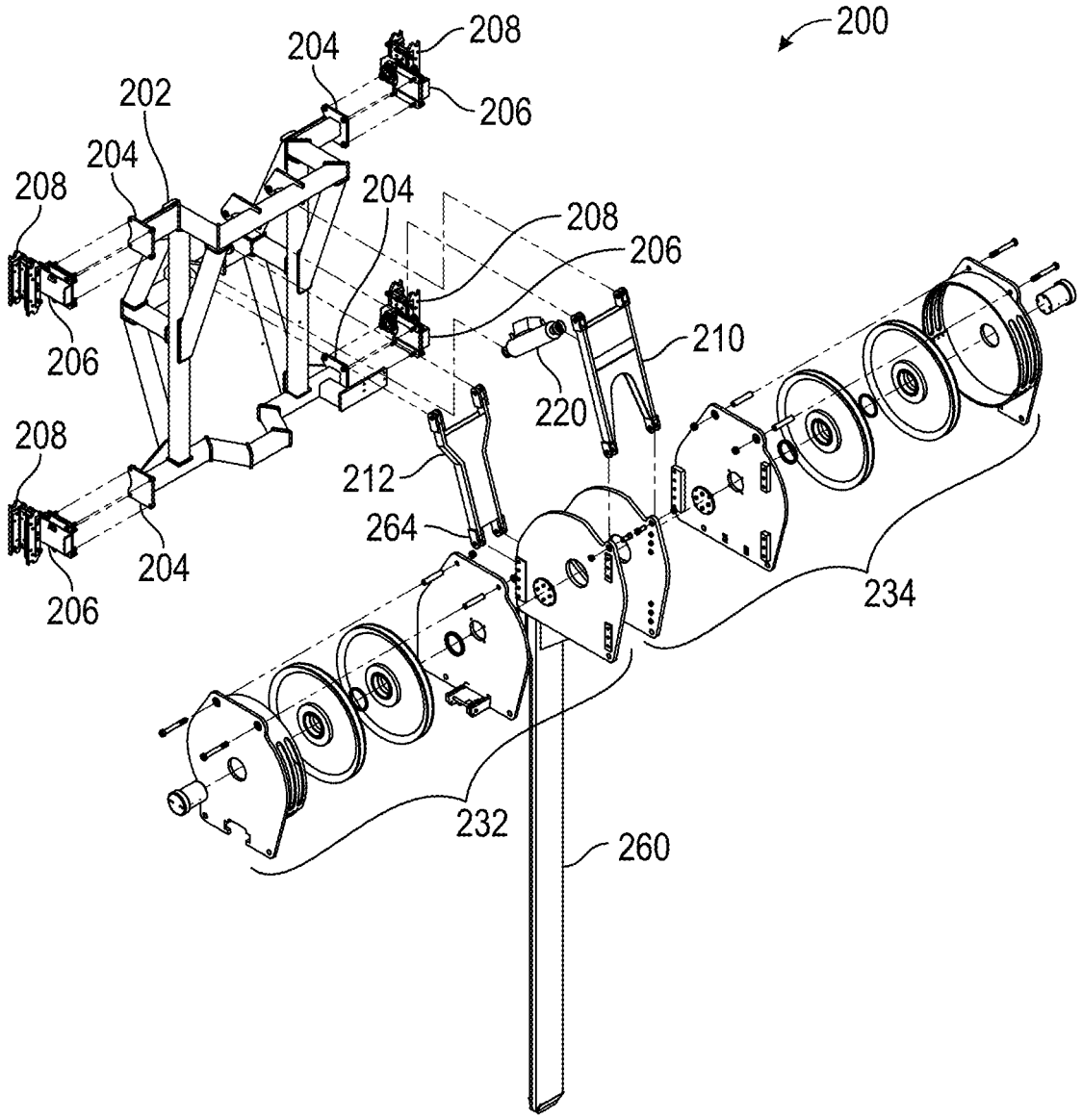
FIG. 3 is an isometric exploded view of components of an embodiment of the present invention. This view illustrates the dolly and rail connectors, pivotal yokes, sheaves, and torque tube.

FIG. 3 is an isometric exploded view of components of an embodiment of RTD 200. This view more clearly illustrates dolly 202 and its connected components. Each dolly end 204 has an adjustment pad 206 between its end 204 and slide pad 208. Slide pads 208 engage guides 17 to guide RTD 200 up and down the vertical length of mast 10. Adjustment pads 206 permit precise centering and alignment of dolly 202 on mast 10.

In the embodiment illustrated, RTD 200 has a split block including a driller's side block 232 and an off-driller's side block 234. This feature provides mast-center path clearance additional to that obtained by the ability to retract dolly 202.

First yoke 210 pivotally connects block halves 232 and 234 to dolly 202, and provides their separation and alignment on a common axis of rotation. Second yoke 212 pivotally connects block halves 232 and 234 to dolly 202, and stabilizes their separation and alignment. Torque tube 260 is connected to the intersection of second yoke 212 and block halves 232 and 234 to secure it to the travelling block assembly 230.

Actuator 220 extends between yoke 210 and dolly 202 to facilitate controlled movement of the RTD between a well center position and a retracted position. Connection 264 represents a point on sheave assemblies 232 and 234 of travelling block assembly 230 where torque tube 260 is connected.

Figure 4:
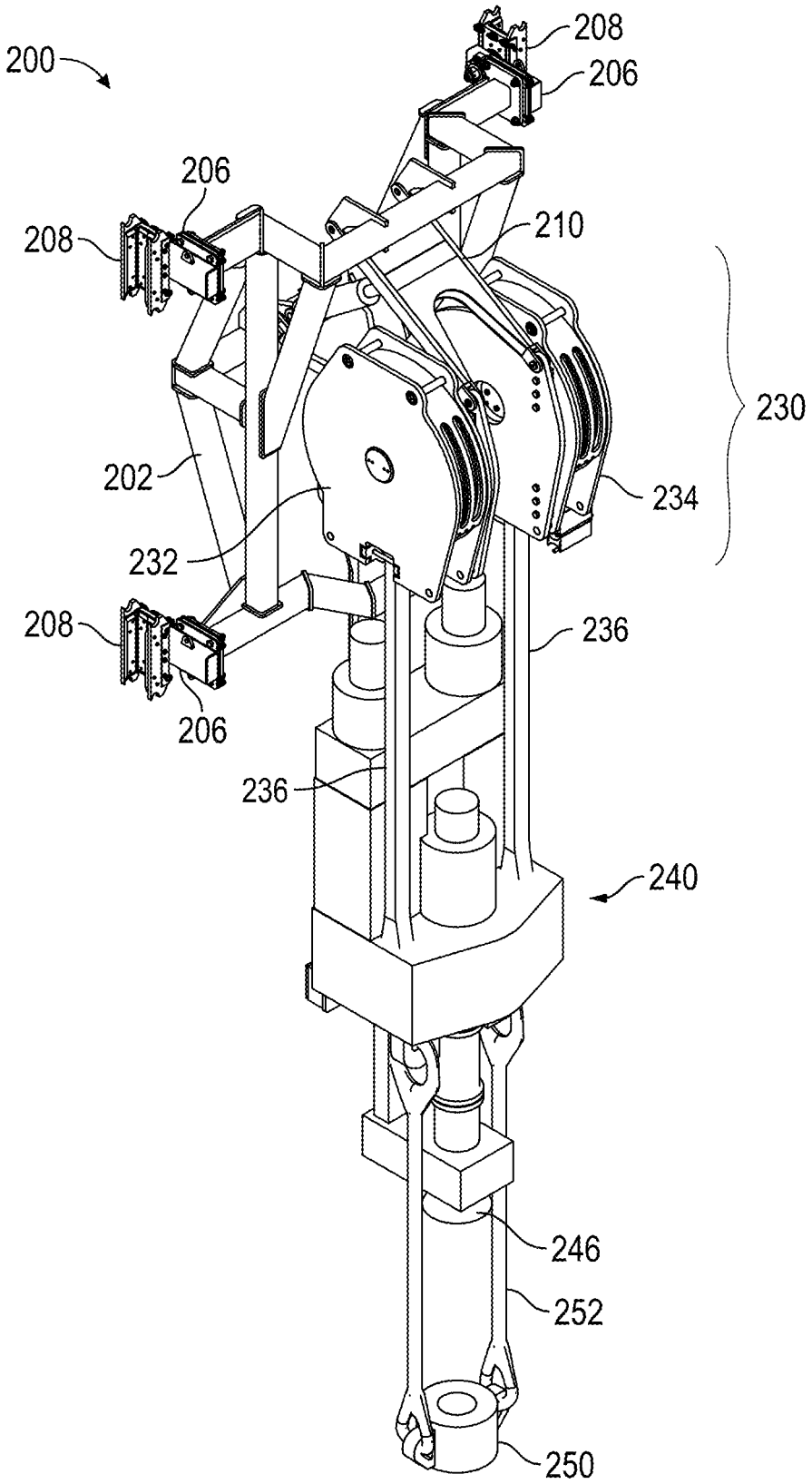
FIG. 4 is an isometric view of an embodiment of the retractable top drive (RTD) of the present invention.

FIG. 4 is an isometric view of the embodiment of RTD 200 as assembled, and including the complete travelling block and top drive assemblies. As seen in this view, RTD 200 includes a top drive motor 240 and a stabbing guide 246. Pivotal links 252 extend downward. An automatic elevator 250 is attached to the ends of links 252. Travelling block assembly 230 is generally comprised of sheave assemblies 232 and 234, and links 236.

Figure 5:
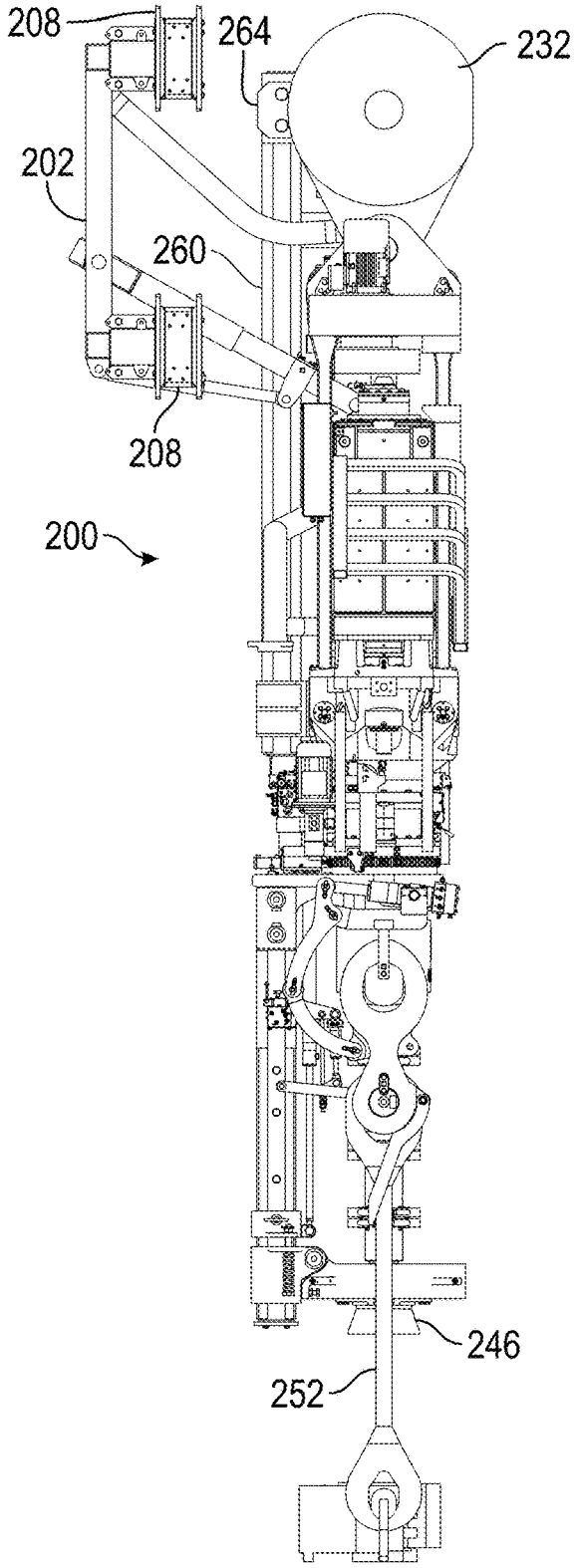
FIG. 5 is a side view of an alternative embodiment of the RTD of the present invention, showing it positioned over the well center.

FIG. 5 is a side view of an alternative embodiment of RTD 200, showing it positioned over the well center 30. In this embodiment, torque tube 260 is connected directly to travelling block 230 at connection 264.

Figure 6:
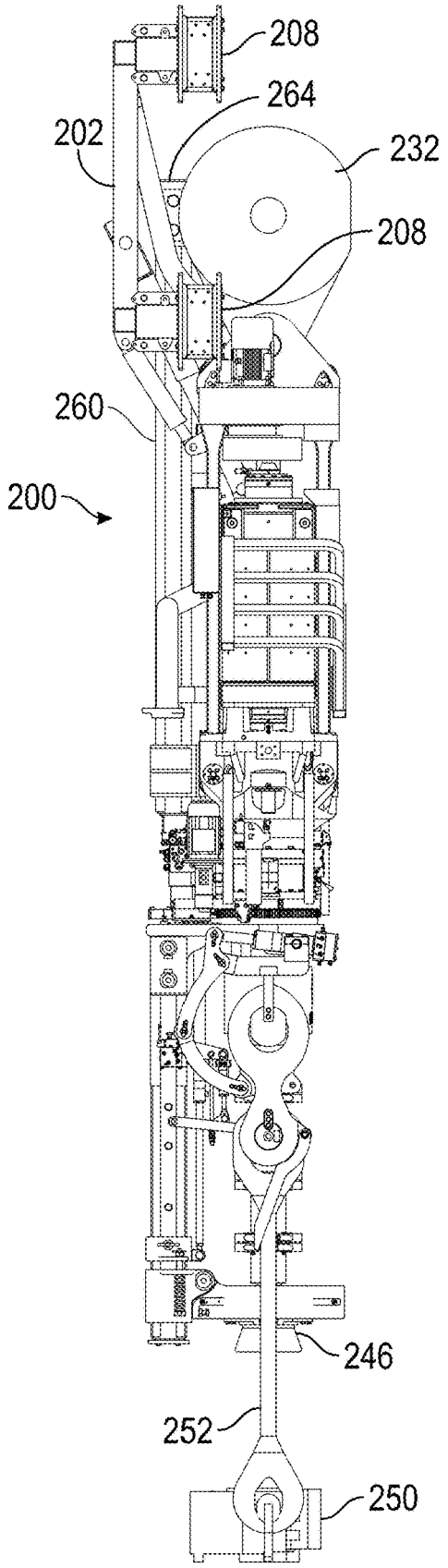
FIG. 6 is a side view of the embodiment of the RTD of FIG. 5, showing it retracted from its position over the well center.

FIG. 6 is a side view of the embodiment of the RTD 200 of FIG. 5, showing it retracted from its position over the well center 30.

Figure 7:
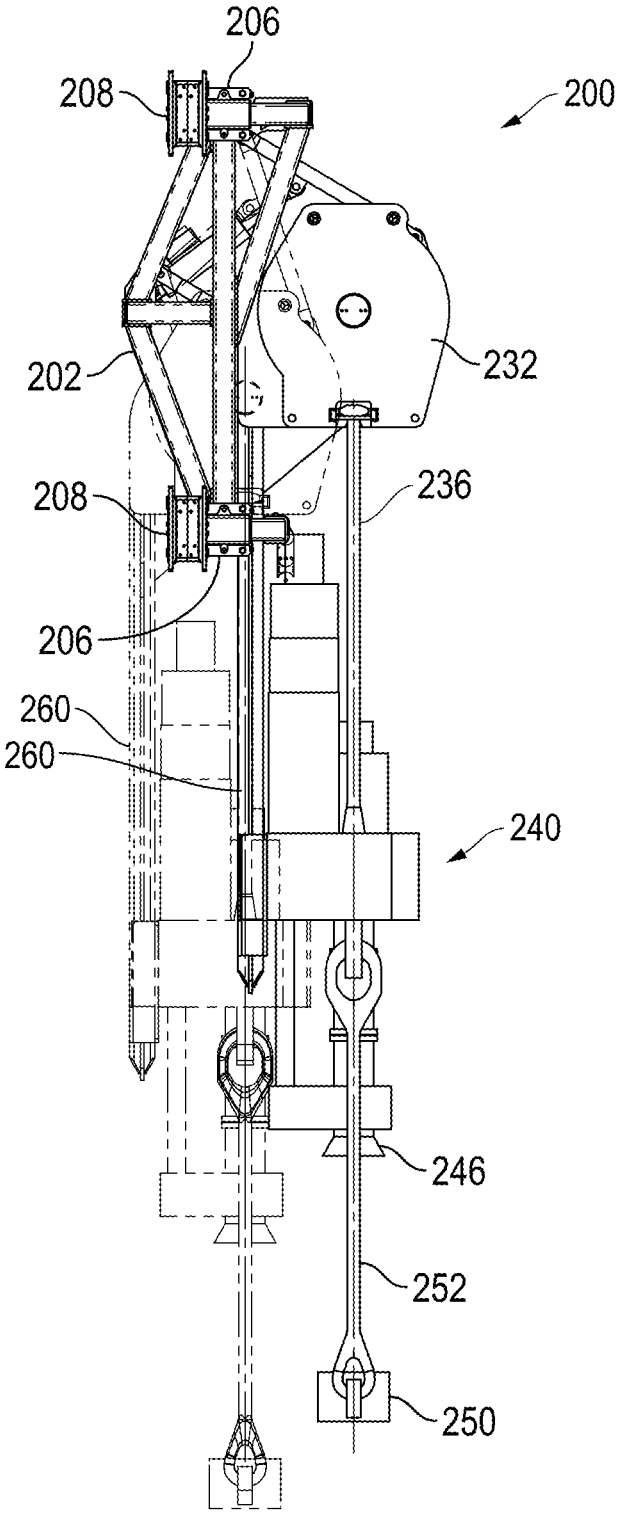
FIG. 7 is a side view of the embodiment of the RTD of FIGS. 3 and 4, illustrating the relative positions of the RTD when moved between the well center position and the retracted position, with the retracted position illustrated in dashed lines.

FIG. 7 is a similar side view, showing the embodiment of RTD 200 of FIGS. 3 and 4, illustrating the relative positions of the RTD 200 when moved between the well center 30 position and the retracted position, with the retracted position illustrated in dashed lines.

Figure 8:
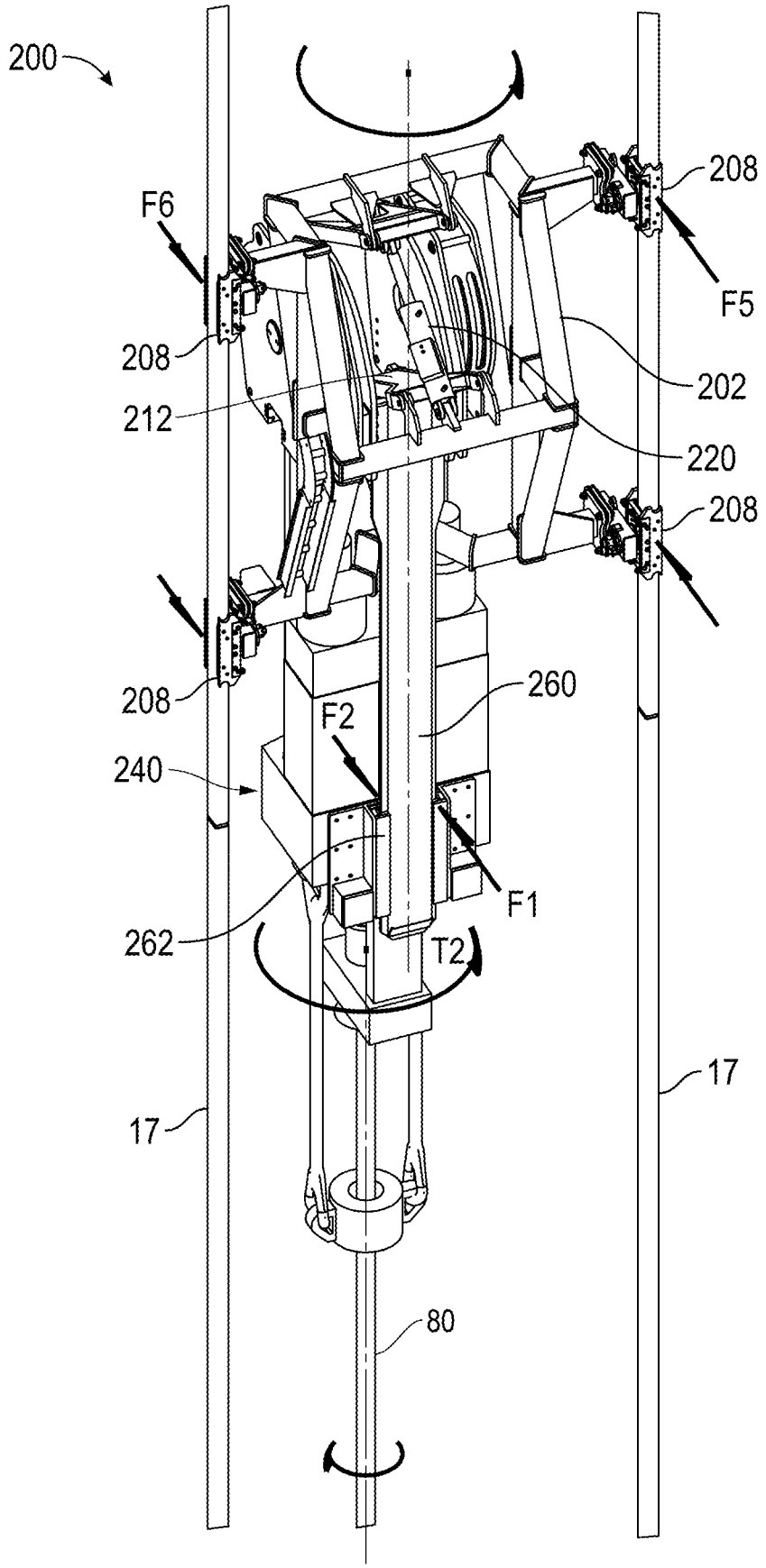
FIG. 8 is an isometric cut-away view, illustrating the force transmitted through the torque tube connected directly to the travel block.

FIG. 8 is an isometric cut-away view, illustrating the force transmitted through torque tube 260 connected directly to the travel block assembly. In this view, RTD 200 is positioned over well center 30. Slide pads 208 are seen mounted on opposing ends 204 (not visible) of dolly 202 that extend outward in the driller's side and off-driller's side directions, and engage rails 17 on mast 10.

Central to this invention, RTD 200 has a torque tube 260 that functions to transfer torque from RTD 200 to dolly 202 and there through to guides 17 and mast 10, even though the top drive is not directly connected to a dolly of its own. Torque is encountered from make-up and break-out activity as well as drilling torque reacting from the drill bit and stabilizer engagement with the wellbore. Torque tube 260 is engaged to top drive 240 at torque tube bracket 262 in sliding relationship. Top drive 240 is vertically separable from the travelling block assembly to accommodate different thread lengths in tubular couplings. The sliding relationship of the connection at torque tube bracket 262 accommodates this movement. Torque tube 260 is affixed to the travelling block assembly above top drive 240. As shown, torque tube 260 is connected to the travelling block assembly at the intersection of second yoke 212 and block halves 232 and 234.

As seen in FIG. 8, tubular stand 80 is right rotated by top drive 240 as shown by T1. Drilling related friction at the drill bit, stabilizers and bottom hole assembly components must be overcome to drill ahead. This results in a significant reactive torque T2 at top drive 240. Torque T2 is transmitted to torque tube 260 through opposite forces F1 and F2 at bracket 262. Torque tube 260 transmits this torque to second yoke 212, which transmits the force to connected dolly 202. Dolly 202 transmits the force to rails 17 of mast 10 through its slide pads 208.

By this configuration, torque tube 260 is extended and retracted with top drive 240 and the travelling block. By firmly connecting torque tube 260 directly to the travelling block and eliminating a dolly at top drive 240, RTD 200 solves the design problems necessary to accommodate a second hoisting machine on a common mast 10.

It will be appreciated by a person of ordinary skill in the art that the procedure illustrated, although for "tripping in" in a well, can be generally reversed to understand the procedure for "tripping out."

If used herein, the term "substantially" is intended for construction as meaning "more so than not."

Figures 9A, 9B:
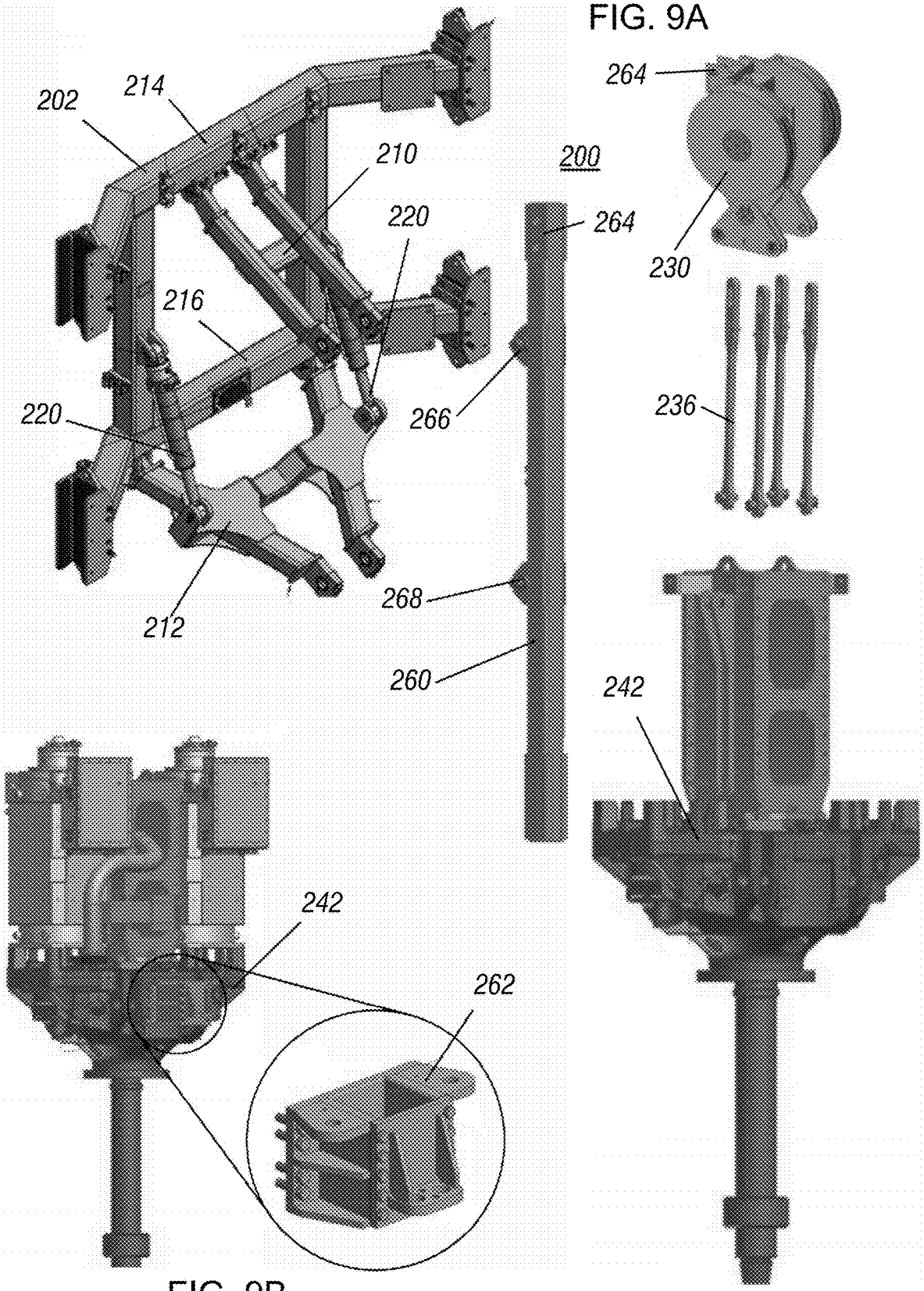
FIG. 9A is an isometric exploded view of an alternative embodiment of an RTD, wherein a second yoke brakes the torque from the top drive more directly from the torque tube.
FIG. 9B is a perspective view of a rear side (drawworks side) of a top drive gearbox assembly, wherein a torque tube bracket is enlarged for illustrative purposes.

FIG. 9A illustrates an exploded view of an alternative embodiment of an RTD 200. The RTD 200 has a dolly 202, a torque tube 260, a travelling block assembly 230, links, and a gearbox subassembly 242. The dolly 202 has a first yoke 210 and a second yoke 212. The first yoke 210 is pivotally attached at two locations to an upper beam 214 of the dolly 202. Opposite the dolly 202, the first yoke 210 is pivotally attached to an upper bracket 266 of the torque tube 260. The second yoke 212 is pivotally attached at two locations to a lower beam 216 of the dolly 202. The points of attachment are wide apart on the lower beam 216 to allow the second yoke 212 to brace against torque induced by the top drive. In one embodiment of the invention, the points of attachment are separated by a distance more than ⅓ the width of the dolly 202. Opposite the dolly 202, the second yoke 212 is pivotally attached to a lower bracket 268 of the torque tube 260. Two actuators 220 are connected between the second yoke 212 and the dolly 202. In this embodiment, the two actuators 220 are hydraulic pistons that extend and retract to rotate the second yoke 212 about its pivotable attachment points to the dolly 202. The two actuators 220 move the RTD 200 between retracted and extended configurations, as described more fully below. In this embodiment, actuators are hydraulic pistons. In alternative embodiments, the actuators may be gear systems, pneumatic pistons, pulley systems, servomechanisms, etc. or any other actuator device known to persons of skill in the art.

Still referring to FIG. 9A, the travelling block assembly 230 mounts to the upper end of the torque tube 260 via a connection 264. The gearbox subassembly 242 is suspended from the travelling block assembly 230 via links 236. The gearbox subassembly 242 is also mounted to the torque tube 260 via a torque tube bracket 262 (see FIG. 9B). As oriented in FIG. 9A, the torque tube bracket 262 is mounted on the rear side (drawworks side) of the gearbox subassembly 242, and is not shown in the figure. FIG. 9B shows the front side (racking module side) of the gearbox subassembly 242 and the torque tube bracket 262 is enlarged to be more clearly visible in the figure. The torque tube bracket 262 slides along the torque tube 260 to enable the gearbox subassembly 242 to move vertically relative to the travelling block assembly 230, where the links 236 provide sufficient "play" to allow the vertical movement as pipes are spun relative to each other to make up and break out connections in a drill string. The reason for this motion is to provide for thread advancement when making or breaking a pipe or casing connection at the well center. Compensator cylinders (not shown in the figures) move the top drive 240 vertically relative to the travelling block 230. Referring to FIG. 9B, the links 236 have slots in the upper ends to allow the top drive to move vertically with respect to the travelling block 230.

Figure 10A:
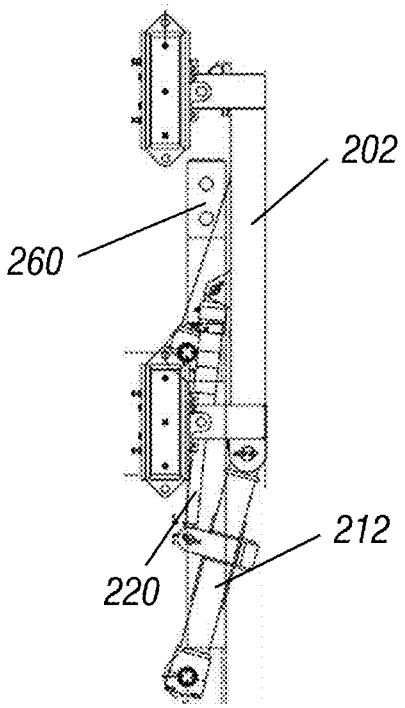
FIG. 10A is a side view of the RTD of FIG. 9A, shown in a retracted configuration.
Figure 10C:
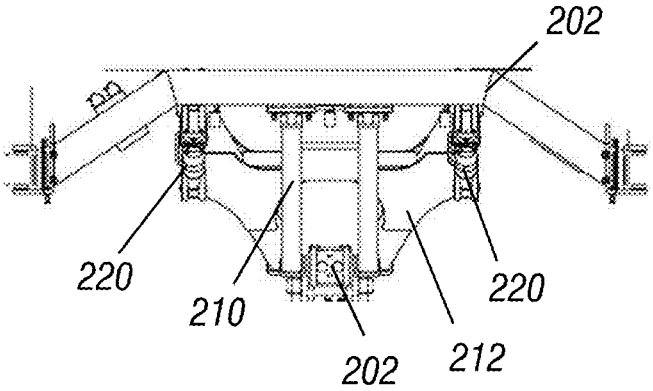
FIG. 10C is a top view of the RTD of FIG. 9A, shown in an extended configuration.
Figure 10B:
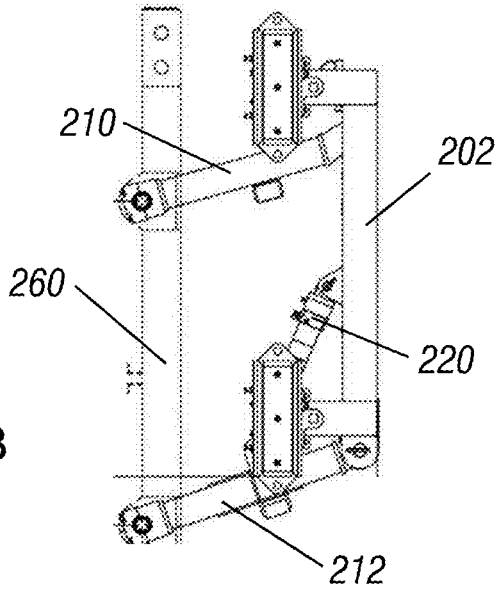
FIG. 10B is a side view of the RTD of FIG. 9A, shown in an extended configuration.

FIGS. 10A-10C illustrate the RTD 200 of FIG. 9A. FIG. 10A is a side view of the RTD 200 in the retracted configuration. FIG. 10B is a side view of the RTD 200 in the extended configuration. FIG. 10C is a top view of the RTD 200 in the retracted configuration.

Figure 11A:
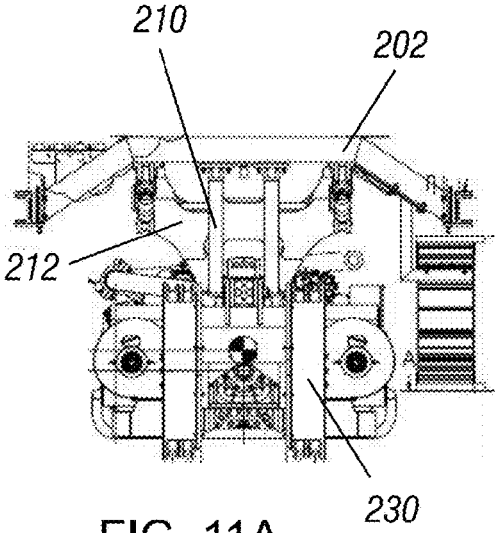
FIG. 11A is a top view of the RTD of FIG. 9A and a top drive, shown in an extended configuration.
Figure 11B:
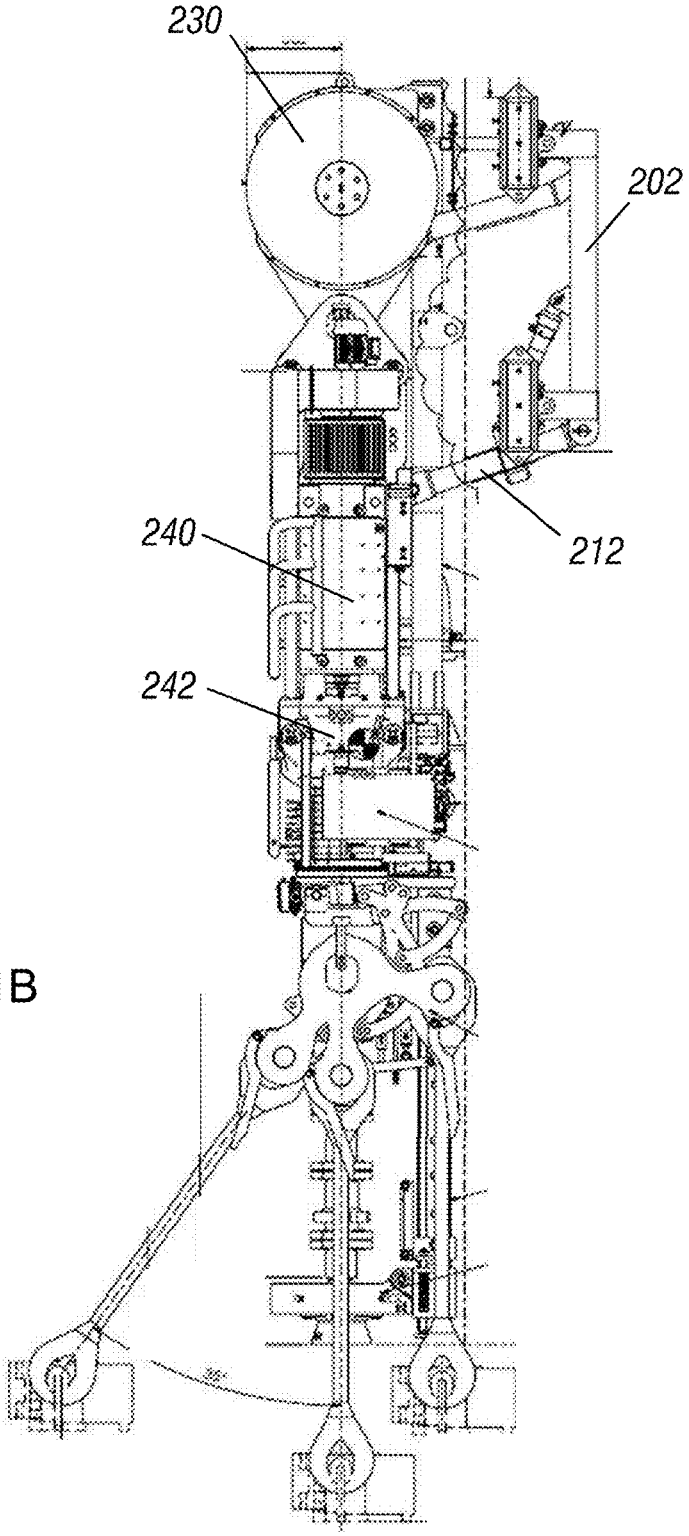
FIG. 11B is a side view of the RTD of FIG. 9A and a top drive, shown in an extended configuration.

FIG. 11A shows a top view of the RTD 200 of FIG. 9A, in the extended configuration, with a travelling block assembly and gearbox subassembly and top drive motors. FIG. 11B shows a side view of the RTD 200 of FIG. 9A, in the extended configuration.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

Although the disclosed embodiments are described in detail in the present disclosure, it should be understood that various changes, substitutions and alterations can be made to the embodiments without departing from their spirit and scope.

INDUSTRIAL APPLICABILITY

Retractable top drives for drilling rigs of the of the present invention have many industrial applications including but not limited to drilling vertical well bores and long lateral sections in horizontal wells for the oil and gas industry.

What is claimed is:

1. A top drive for a wellbore drilling rig, the top drive comprising:

a dolly configured to be supported by a mast of the drilling rig so that the dolly is substantially vertically translatable relative to the mast;

a yoke having a first end in mechanical communication with the dolly;

a travelling block directly connected to a second end of the yoke;

a torque tube directly connected to the travelling block and the second end of the yoke;

a top drive motor slidably mounted to the torque tube so that a substantial portion of the top drive motor is lower than a substantial portion of the dolly and any torque generated by the top drive motor is transmitted from the top drive motor through the torque tube through the yoke through the dolly and into the mast; and an actuator in mechanical communication with the yoke to translate the top drive motor in a direction having a horizontal component relative to the dolly.

2. The top drive as claimed in claim 1, wherein the first end of the yoke is pivotably mounted to the dolly and the second end of the yoke is pivotably mounted to the torque tube.

3. The top drive as claimed in claim 1, wherein the first end of the yoke is in mechanical communication with the dolly at two points, wherein the two points are separated from each other by a distance more than one third the width of the dolly.

4. The top drive as claimed in claim 1, wherein the actuator comprises at least one piston.

5. The top drive as claimed in claim 1, wherein the top drive motor is in mechanical communication with the torque tube via a torque tube bracket.

6. The top drive as claimed in claim 1, wherein the top drive motor is slidably mounted to the torque tube so as to allow the top drive motor to move vertically relative to the torque tube, whereby vertical movement of the top drive motor allows for thread advance when making or breaking a pipe or casing connection.

7. The top drive as claimed in claim 1, wherein the top drive motor is suspended from the travelling block.

8. The top drive as claimed in claim 1, further comprising an additional yoke, wherein the additional yoke has a first end in mechanical communication with the dolly and a second end in mechanical communication with the torque tube.

9. The top drive as claimed in claim 8, wherein the first end of the additional yoke is pivotably mounted to the dolly and the second end of the additional yoke is pivotably mounted to the torque tube.

10. The top drive as claimed in claim 1, further comprising at least one adjustment pad configured to adjust a position of the dolly relative to the mast of the drilling rig.

11. A process for operating a drilling rig, the process comprising:

mounting a dolly to a rig mast so that the dolly is substantially vertically translatable relative to the rig mast;

pivotally mounting a first end of a yoke to the dolly;

directly mounting a travelling block to a second end of the yoke;

directly connecting a torque tube to the travelling block and the second end of the yoke;

slidably mounting a top drive motor to the torque tube so that a substantial portion of the top drive motor is lower than a substantial portion of the dolly and the top drive motor is translatable in a direction having a horizontal component relative to the dolly; and transferring torque from the top drive motor through the torque tube through the yoke through the dolly and into the mast.

12. The process for operating a drilling rig as claimed in claim 11, wherein slidably mounting the top drive motor to the torque tube allows for thread advance when making or breaking a pipe or casing connection.

13. The process for operating a drilling rig as claimed in claim 11, further comprising:

mechanically communicating the yoke to the dolly at two points, wherein the two points are separated from each other by a distance more than one third the width of the dolly.

14. The process for operating a drilling rig as claimed in claim 11, further comprising translating the top drive motor in a direction having a horizontal component relative to the dolly via an actuator.

15. The process for operating a drilling rig as claimed in claim 11, wherein the top drive motor is suspended from the travelling block.

16. The process for operating a drilling rig as claimed in claim 11, wherein the transferring torque from the top drive motor through the torque tube through the yoke through the dolly and into the mast comprises further transferring torque through the travelling block.

* * * * *